US005890625A

United States Patent [19]

de Laforcade

[11] Patent Number: 5,890,625

[45] Date of Patent: Apr. 6, 1999

[54] DEVICE FOR THE FRACTIONAL EMPTYING OF A TUBE

[75] Inventor: Vincent de Laforcade, Rambouillet, France

[73] Assignee: L'Oreal, Paris, France

[21] Appl. No.: 108,245

[22] Filed: Jul. 1, 1998

[30] Foreign Application Priority Data

Jul. 1, 1997 [FR] France ..... 97 08282

[51] Int. Cl.[6] ..... B65D 35/28

[52] U.S. Cl. ..... 222/103

[58] Field of Search ..... 222/103, 105

[56] References Cited

U.S. PATENT DOCUMENTS

| | | | |
|---|---|---|---|
| 3,281,016 | 10/1966 | Thompson | 222/103 |
| 4,172,536 | 10/1979 | Holt . | |
| 5,145,093 | 9/1992 | Zeller . | |

FOREIGN PATENT DOCUMENTS

| | | |
|---|---|---|
| 0 407 320 | 1/1991 | European Pat. Off. . |
| 1 524 378 | 9/1968 | France . |
| 2 694 540 | 2/1994 | France . |
| 79 29 593 | 1/1980 | Germany . |

OTHER PUBLICATIONS

English language Derwent Abstract of FR 2 694 540.
English language Derwent Abstract of EP 0 407 320.

*Primary Examiner*—Gregory L. Huson
*Attorney, Agent, or Firm*—Finnegan, Henderson, Farabow, Garrett, & Dunner L.L.P.

[57] ABSTRACT

The present application relates to a device for the emptying of a tube, comprising a base plate and a cover plate, joined by a hinge connection, so that when the tube is arranged between the base plate and the cover plate, with the tube seam line situated in the vicinity of the hinge, the folding of the cover plate onto the base plate drives the product toward the opening of the tube. According to the invention, the cover plate can comprise at least two segmented parts hingedly connected, in such a way as to make it possible to selectively bring all or part of the cover plate to bear on the base plate, thereby allowing the total or fractional emptying of the tube.

14 Claims, 4 Drawing Sheets

DEVICE FOR THE FRACTIONAL EMPTYING OF A TUBE

Figure 1:
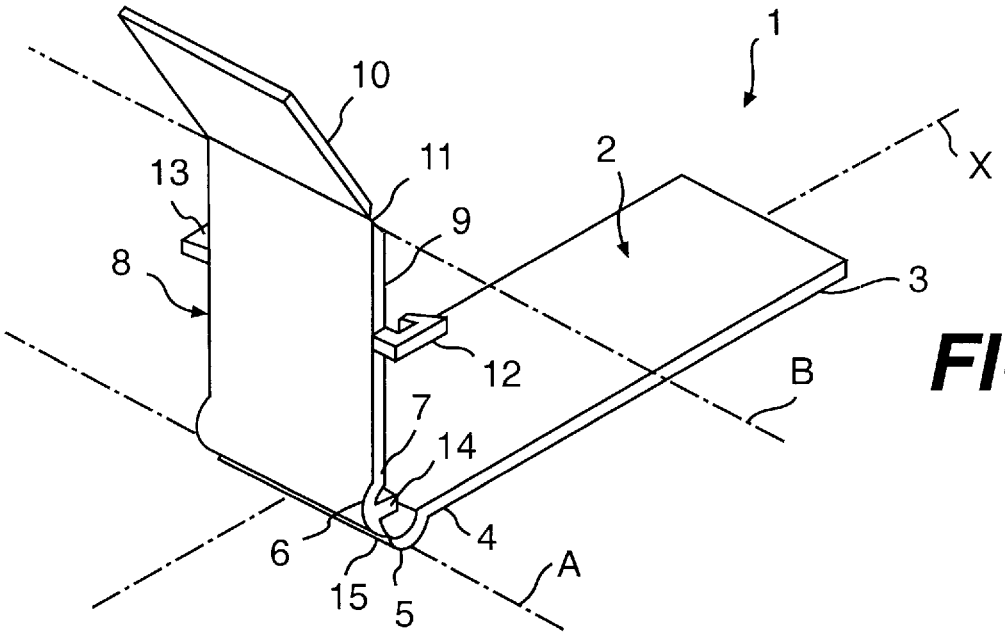

The present invention concerns a device for the fractional emptying of a tube with deformable walls, containing a product of the cream or paste type. The invention is particularly suitable for the emptying of tubes formed of aluminium, or of a composite comprising at least one layer of aluminium. Such tubes are used especially in the field of cosmetics, and in particular for packaging hair tinting products, especially for highlights.

Numerous devices have been proposed to aid the emptying of tubes, and in particular of aluminium tubes. Mention may be made, for example, of the "sardine key" which consists in emptying the tube by winding its extremity onto a cylinder of small diameter. Such devices constitute a considerable advance as compared with the technique consisting in expelling the product by squeezing the tube with the fingers. However, although efficient, this device does not offer the possibility of emptying the tube with one hand, nor of ascertaining the quantity of product remaining, nor even of ascertaining the quantity of product discharged.

In certain fields, in particular in the field of hair tinting, on account of the relatively high cost price of this type of packaging, it has been proposed to package, within one tube, the quantity of product required for at least two uses, thus entailing a fractional use of the contents of the tube. In the field of hair tinting, the quality of the result, in particular its reproducibility, depends to a large extent on complying with the quantities of product to be used. This requirement for accurate dosing is incompatible with the conventional techniques for emptying tubes, which allow only approximate dosing of the quantity of product used. Furthermore, an intricate maneuver is required, in particular, when the product dispensed is to be applied directly to the hair, by means of a nozzle arranged on the neck of the tube. Finally, it turns out that the degree of emptying of the tubes is hardly sufficient, generally less than or equal to 80%, depending on the viscosity of the product. This is not satisfactory either for the consumer, or for the manufacturer of such products, on account of the need for more product than necessary to be packaged in the tube.

European Patent Application EP A 0 407 320 relates to a device for extruding the contents of a sachet, in the form of V-shaped tongs actuated by the user and furnished with a region of lesser thickness forming a hinge. The tongs can be made by injection, followed by folding in the vicinity of the hinged region, using a material of a type known commercially as RIGIPLAST®.

Such a device, although satisfactory for the application that it describes, is not satisfactory should a fractional use of the contents of the sachet be required. This is because the quantity of product dispensed cannot be dosed accurately. Furthermore, the use of such a device for emptying a sachet poses no problem, to the extent that, on account of its relatively flat shape, the sachet has no tendency to slip axially under the effect of the pressure exerted on the sachet sandwiched between the cover plate and the base plate. This is not true for a packaging in the form of a tube, which typically has a part inclined towards the seam line obscuring the bottom thereof.

U.S. Pat. No. 5,145,093 describes a device for emptying a toothpaste tube, in the form of tongs, comprising a base plate and a cover plate, which is at most half as long as the base plate, and allowing two-stage emptying of the contents of the tube. For this purpose, after the partial emptying of the tube, the emptied part must be folded onto the non-emptied part of the tube, and the tube thus folded must be placed back in the tongs in order to extrude the second half of the tube.

The device described in this document suffers from several drawbacks. For example, the base plate extends beyond the shoulder of the tube so that it is not possible to obtain as high a degree of emptying as desirable. Moreover, when emptying the second part of the tube, there is a risk that part of the product will inadvertently flow over the base plate. Further, nothing is provided to prevent the tube from slipping axially under the effect of the pressure exerted by the cover plate.

Thus, one of the objects of the invention is to provide a device that allows, in a simple and accurate manner, the total or fractional emptying of the contents of a tube, doing so with a degree of discharge greater than the degree of discharge obtained with the conventional methods or devices.

Another object of the invention is to provide a device for the fractional emptying of the contents of a tube that allows accurate and reproducible dosing of the quantity of product dispensed.

Yet another object of the invention is to provide a device making it possible to selectively, depending on the application, empty the tube entirely or only a fraction thereof, which fraction is to be determined as accurately as possible.

Yet other objects will emerge in more detail from the description that follows.

According to the invention, these objects are achieved by making a device with axis X for emptying a tube formed of a body with deformable walls, a first end of which is closed along a line, preferably, a seam line, forming an extremity, a second end being surmounted by a neck defining an opening for the exit of a product contained in the tube, the neck being joined to the body by a shoulder, the device comprising a base plate whose length is slightly less than the under-shoulder height of the tube, a cover plate of axial length substantially identical to the length of the base plate, and hinged to the base plate about an axis A perpendicular to the axis X so that when the tube is arranged between the base plate and the cover plate, with the line, preferably the seam line, situated in the vicinity of the axis A, the folding of the cover plate onto the base plate drives the product toward the opening and causes the squeezing of the walls of the tube between the base plate and the cover plate, wherein the cover plate comprises at least two parts hinged about an axis parallel to the axis A, in such a way as to make it possible selectively to bring all or part of the cover plate to bear on the base plate, and to allow the total or fractional emptying of the tube.

The device according to the invention is particularly advantageous in that it is extremely inexpensive to make. It also is simple to use. In particular, it can be used with one hand, thus making it possible, as the case may be, to use the other hand to hold the receptacle into which the product is discharged. Furthermore, the dosing of a fraction of the contents of the tube is more accurate than the dosing allowed by conventional devices. Further, the degree of emptying is very high.

Advantageously, means are arranged in the vicinity of the axis of hinging A so as to hold the line, preferably the seam line, of the tube and immobilize the tube between the cover plate and the base plate. Such means make it possible to prevent, when pressure is exerted on the cover plate, the tube from being pushed forward through the effect of the slipping of the cover plate on the inclined part of the tube.

For this purpose, the cover plate and the base plate advantageously form a reinforcement in the vicinity of the axis A, on either side of the axis, the means for holding the line, preferably the seam line, comprising at least one member, situated inside one of the reinforcements, the member having a free end, and is arranged in such a way that when the cover plate is folded onto the base plate the free end intercepts a closure plane passing through the axis A and parallel to the base plate. Preferably, the reinforcements are semi-cylindrical.

The member can comprise a rib or at least one peg oriented along the axis A. In the case of pegs, several pegs arranged regularly over the width of the device (i.e., parallel to the axis A) can be used. In the case of a rib, the latter preferably stretches over the whole width of the device. Thus, by closing the cover plate onto the base plate, the pegs or the rib bear on the seam region or weld region of the tube and force this region into the reinforcement formed by the base plate. The tube is then fixed and cannot possibly slip forward.

According to one embodiment, the cover plate comprises two parts, one distal, situated away from the axis A, the other proximal, adjacent to the axis A, the two parts being joined by a hinge connection permitting the complete folding of the distal part onto the proximal part. In particular, this simplifies the intricate maneuver required to empty the first portion of the tube.

Preferably, the hinge connection joining the two parts forming the cover plate is arranged in such a way that bringing the proximal part to bear on the base plate causes the emptying of half the contents of the tube. The position of the hinge connection region joining the two parts forming the cover plate is determined in particular as a function of the shape of the tube. For this purpose, in the case in which the tube is to be emptied in two equal fractions, the position of the hinge connection region might not coincide with half the length of the cover plate. This depends in particular on the geometry of the tube.

According to another advantageous characteristic of the invention, means are provided for holding the proximal part in a position folded onto the base plate, after emptying of that part of the tube that is situated between the base plate and the said proximal part. This characteristic is particularly advantageous in that it makes it possible, after using the first part of the tube, to store the latter away while keeping it held inside the device according to the invention. Thus, the product remaining in the top part of the tube cannot flow back into the bottom part of the tube.

By way of example, the proximal part is held in a position folded onto the base plate by clipping, by means of at least one catch provided on one or other of the base plate or cover plate.

The base plate can be of slightly concave shape, the concavity being oriented to the side of the cover plate. This makes it possible to compensate for the effect linked with the intrinsic flexibility of the base plate, depending on the nature of the material used and its thickness, and also makes it possible to reduce the effort required to empty the tube. By way of illustration, the concavity may have a radius of curvature of from 1 m to infinity.

Preferably, the hinge connection formed about the axis A, as well as that (or those) joining the parts forming the cover plate, consist of film hinges. Such an embodiment is particularly advantageous when the device is made by molded thermoplastic materials.

Although it can be used with tubes constructed from other materials, for example, thermoplastics, the device according to the invention is particularly adapted for tubes formed of aluminium or of a composite comprising at least one layer of aluminium.

The product contained in the tube can, for example, be a hair tinting product.

The invention comprises, apart from the provisions set out above, a number of other provisions that will be explained below, in conjunction with non-limiting embodiments described with reference to the appended figures in which:

FIG. 1 represents a perspective view of a first embodiment of the device according to the invention; and FIGS. 2A, 2B, 3A, 3B, 4A, and 4B represent various views illustrating the operation of the device according to the invention.

As represented in FIG. 1, the device 1 according to the invention comprises a base plate 2, of generally rectangular shape and the dimensions of which are adapted to the dimension of the tube to be emptied. The base plate 2 comprises a free end 3. The end 4 opposite the free end forms a first reinforcement 5 of semi-cylindrical cross-section, the function of which will be explained in greater detail below. The reinforcement 5 is joined to a second reinforcement 6, with substantially identical cross-section to that of the first reinforcement 5, formed by a first end 7 of a cover plate 8. The hinge connection of the cover plate 8 to the base plate 2 takes place about an axis A perpendicular to the axis X of the device. Advantageously, the hinge connection is a film hinge 15 joining two adjacent edges of the reinforcements 5, 6.

The shape and the dimensions of the cover plate 8 are substantially identical to those of the base plate 2, so that in the closed position the two plates 2, 8 lie substantially one above the other. Preferably, the cover plate 8 comprises two segmented parts 9, 10 joined by a film hinge 11 enabling the part 10 to be folded onto the part 9, about an axis B, parallel to the axis A, as will be seen in greater detail below. In this embodiment, the film hinge 11 is situated substantially in the middle of the cover plate 8, so as to allow the contents of a tube to be emptied in two substantially identical parts. In reality, depending on the shape of the tube, the part 9 can be slightly longer than the part 10.

Thus devised, the segmented part 10 can pivot by an angle of at least 180°, in such a way as to be able on the one hand to fold up completely onto the segmented part 9, when emptying the first part of the tube, and on the other hand, to come into alignment with the part 9 when emptying the second part of the tube. Fastening means, preferably of the catch type 12, 13, are provided on the part 9, on each of its edges, so as to enable the part 9 to be fastened to the base plate 2 after emptying the first half of the tube. All of this will be explained more fully with reference to FIGS. 2A, 2B, 3A, 3B, 4A, and 4B.

A rib 14 is arranged radially over the whole width of the semicylinder formed by the second reinforcement 6. This rib 14 is arranged so that, in the position in which the cover plate 8 is closed onto the base plate 2, the free edge of the rib 14 intercepts the plane of closure of the device 1. Thus, when a tube is arranged inside the device, with a weld region 21 substantially in contact with the film hinge 15 forming the axis A, by folding the cover plate 8 onto the base plate 2, the rib 14 bears on the weld region 21 and causes it to fold into the first reinforcement 5, thus preventing the tube from slipping forward, as mentioned with reference to the device of U.S. Pat. No. 5,145,093. Alternatively, this function is afforded by a row of at least two pegs arranged radially in the reinforcement 6 and aligned parallel to the axis A.

The width of the device along the axis A is preferably slightly greater than the width of the tube. Its length along the axis X is slightly less than the under-shoulder height of the tube. In other words, the axial length of the device (measured between the axis A and the free end of the base plate 2 or of the cover plate 8) is such that, when the tube is positioned in the device, with the weld region 21 correctly positioned with respect to the rib 14, only the part consisting of the shoulder of the tube, the neck and the exit orifice extend beyond the tip of the base plate 2 and of the cover plate 8. Thus, in the closed position of the device, jaws formed by the base plate 2 and the cover plate 8 reach to just under the shoulder of the tube. This characteristic makes it possible to optimize the degree of emptying of the tube.

Figure 2A:
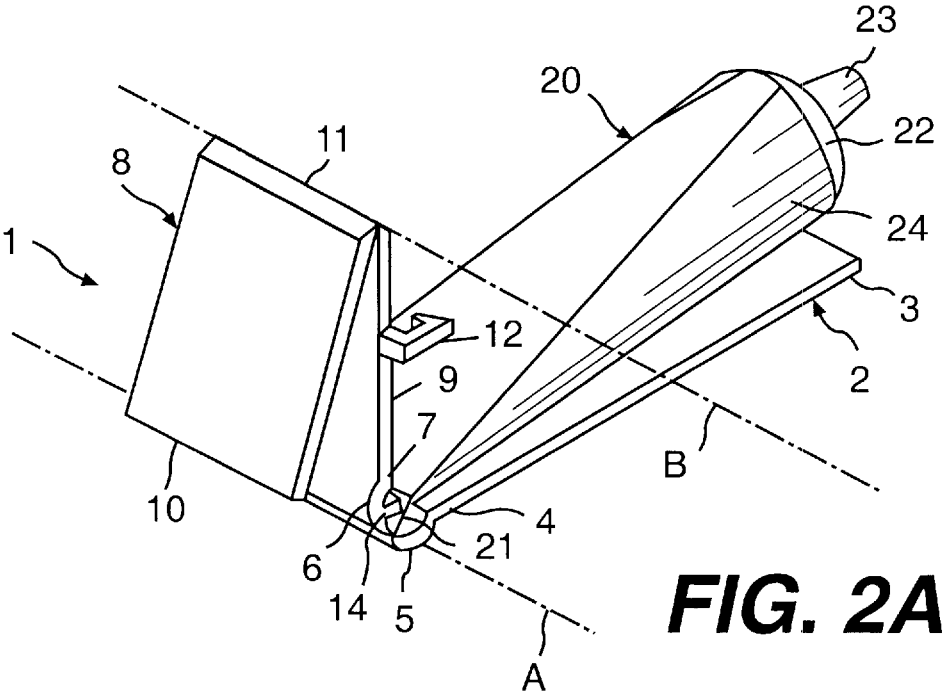
Figure 2B:
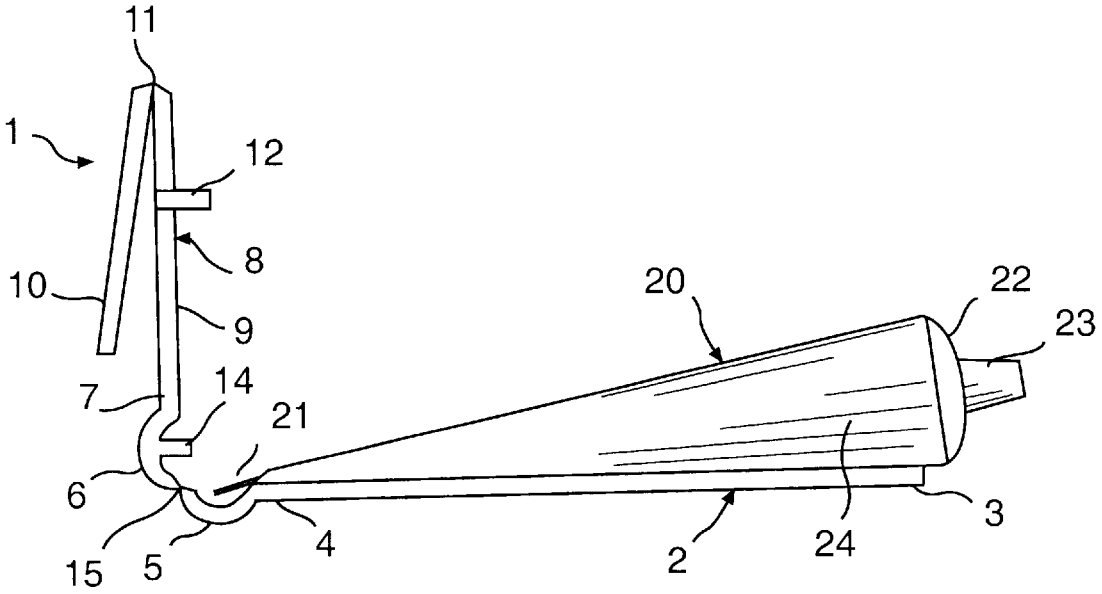

The operation of the device will now be explained with reference to FIGS. 2A, 2B, 3A, 3B, 4A, and 4B. In FIGS. 2A and 2B, the tube 20 is positioned on the base plate 2 with the seam line 21 situated in the vicinity of the axis A. As is clearly apparent, the base plate 2 reaches to just under the shoulder 22 joining the body 24 of the tube 20 to the neck 23. In this representation, the segmented part 10 is folded up onto the segmented part 9 about the axis B formed along the hinge connection 11, so as to enable the first half only of the tube 20 to be emptied.

Figure 3A:
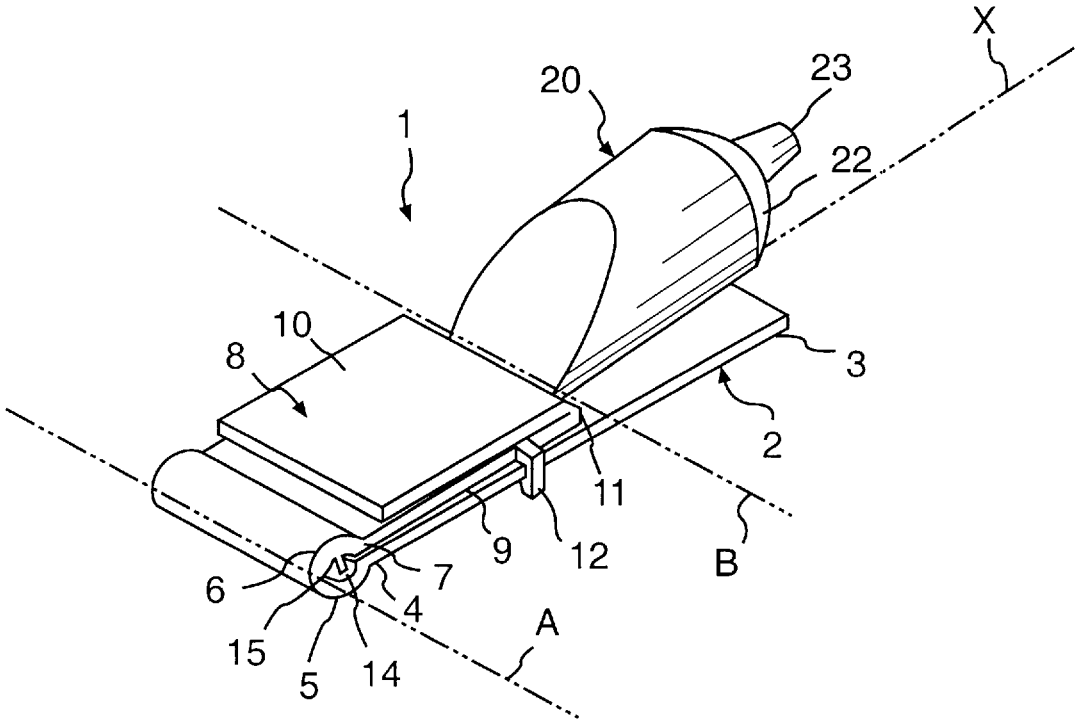
Figure 3B:
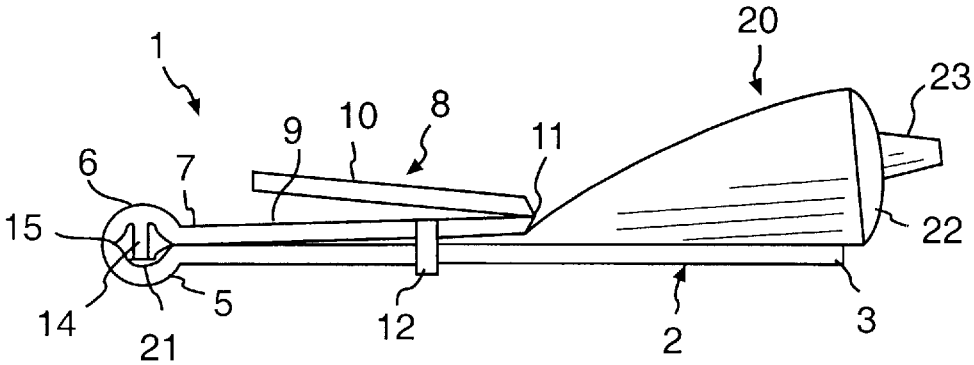

In FIGS. 3A and 3B, the two segmented parts 9, 10 folded onto themselves are turned down onto the bottom part of the tube 20. During this movement, the rib 14 urges the seam region 21 of the tube into the first reinforcement 5, thus preventing any slippage of the tube forward. The pressure exerted on the cover plate 8 drives the product toward the exit orifice, doing so until that part of the tube 20 wedged between the part 9 of the cover plate 8 and the base plate 2 is totally emptied. At this instant, the corresponding part of the body 24 of the tube 20 is flat, preferably perfectly flat. This maneuver can be performed with one hand. After emptying the first half of the tube 20, and assuming that use is made of a device with catches 12, 13 as described with reference to FIG. 1, the part 9 of the cover plate 8 is latched to the base plate 2. The tube 20 can then be reclosed. Until used again, the tube 20 can remain in the device 1 in such a latched arrangement. In particular, this prevents the product contained in the top part of the tube 20 from flowing back into the bottom part should it be accidentally pressed while packaged.

Figure 4A:
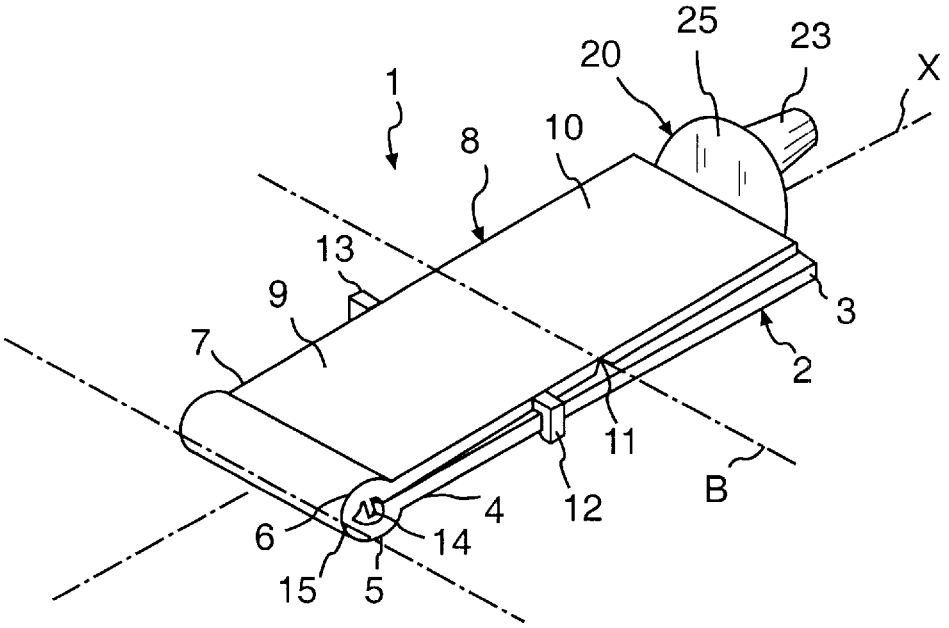
Figure 4B:
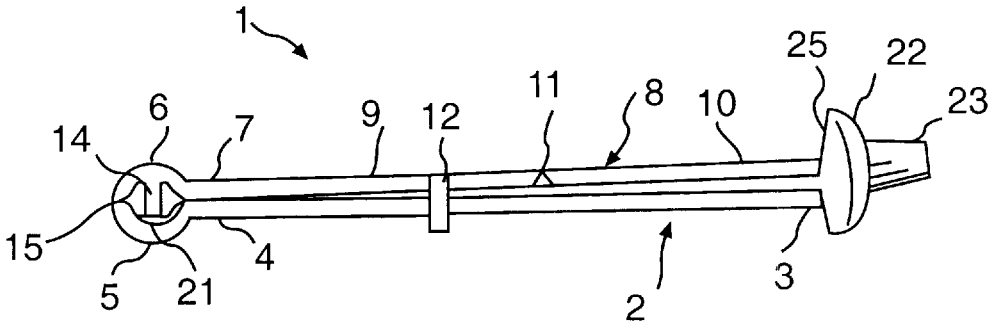

In FIGS. 4A and 4B, the segmented part 10 of the cover plate 8 is unfolded onto the top portion of the tube 20 so as to empty the second half of the tube 20. The pressure exerted by this part 10 of the cover plate 8 causes the product to be expelled from the tube 20 until the tube 20 is emptied, preferably completely emptied. In reality, the ends of the base plate 2 and of the cover plate 8 come just under the shoulder 22 and a small cone 25 remains between the shoulder 22 and the tip of the device 1. The contents remaining in this cone 25 can be emptied substantially by forcing the cone 25 to fold up over the part 10 of the cover plate 8. The degree of emptying is thus approximately or even greater than 95%, this constituting an appreciable advance as compared with the conventional methods and devices.

As emerges from the foregoing description, the device is simple to use, and the fractional dosing of the contents of the tube is carried out accurately. The overall effort to be expended is reduced through the creation of two successive lever arms; a first lever arm with the part 9 of the cover plate 8 as the first point of force, the tube 20 as a fulcrum and the axis A as a point of rotation; and a second lever with the part 10 of the cover plate 8 as a second point of force, with only half the tube as a second fulcrum, and the hinge 11 as a second point of rotation. The device can be used with one hand thus enabling the other hand to hold the receptacle into which the product is discharged.

It is evident that the division into fractions can be effected other than by halves of the tube. Thus, for example, it is possible to envisage a cover plate made of three parts hinged about two axes, each of the axes being positioned in such a way as to empty the tube in thirds. The presence of the cover plate in two or more parts does not preclude, as the case may be, the emptying of the contents of the tube in one operation.

By way of materials used to make the device according to the invention, mention may be made of thermoplastic materials chosen from polyvinyl chlorides, polystyrenes, or any other appropriate material. The device can be made in a single injection-molding operation.

In the foregoing detailed description, reference was made to preferred embodiments of the invention. It is evident that various embodiments may be made without departing from the spirit of the invention as claimed below.

What is claimed is:

1. A device for emptying a tube, said tube having a body with deformable walls, a first end of which is closed along a line, a second end being surmounted by a neck defining an opening for the exit of a product contained in the tube, said neck being joined to the body by a shoulder, said device comprising a base plate whose length is slightly less than the under-shoulder height of the tube and a first axis parallel to the length of the base plate; and a cover plate of axial length substantially identical to the length of the base plate; wherein said cover plate is joined to the base plate with a hinge connection about a second axis, said second axis being perpendicular to the first axis, wherein when said tube is arranged between the base plate and the cover plate, with the line situated in the vicinity of the second axis, the folding of the cover plate onto the base plate drives the product toward the opening and causes the squeezing of the walls of the tube between the base plate and the cover plate; wherein further said cover plate comprises at least two parts hingedly connected about at least one axis parallel to the second axis, so as to make it possible to selectively bring all or part of the cover plate to bear on the tube, and to allow the total or fractional emptying of the tube.

2. A device according to claim 1, wherein said line of the tube is a seam line and further including a retaining mechanism disposed proximate the hinge connection about the second axis so as to hold the seam line of the tube and immobilize the tube between the cover plate and the base plate.

3. A device according to claim 2, wherein said retaining mechanism comprises reinforcements proximate the hinge connection about the second axis, and at least one grip disposed on at least one of the reinforcements, said grip having a free end and being arranged in such a way that when the cover plate is folded onto the base plate, said free end intercepts a closure plane passing through the second axis and parallel to the base plate, and causes the folding of the seam line in the other reinforcement.

4. A device according to claim 3, wherein said grip comprises a rib or at least one peg oriented along the second axis.

5. A device according to claim 1, wherein the hingedly connected parts of said cover plate comprise a distal part and a proximal part, the distal part situated away from the second axis and the proximal part situated adjacent the second axis, wherein said parts can cooperate to permit the complete folding of the distal part onto the proximal part.

6. A device according to claim 5, wherein said hinge connection joining the distal part and the proximal part is arranged in such a way that bringing the proximal part to bear on the base plate causes the emptying of half the contents of the tube.

7. A device according to claim 5, wherein the proximal part and base plate are adapted to permit holding the proximal part in a position folded onto the base plate, after emptying that part of the tube that is situated between the base plate and the proximal part.

8. A device according to claim 7, wherein said proximal part is held in a position folded onto the base plate by at least one catch provided on one or other of the base plate or cover plate.

9. A device according to claim 1, wherein the base plate is of a slightly concave shape, the concavity being oriented toward the cover plate.

10. A device according claim 1, wherein the concavity defines a radius of curvature of from 1 m to infinity.

11. A device according to claim 1, wherein the hinge connections are film hinges.

12. A device according to claim 1, wherein said device is made from molded thermoplastic materials.

13. A device according to claim 1, wherein the tube is formed of aluminium or of a composite comprising at least one layer of aluminium.

14. A device according to claim 1, wherein the product is a hair tinting product.

* * * * *